US006352457B1

(12) United States Patent
Higby et al.

(10) Patent No.: US 6,352,457 B1
(45) Date of Patent: Mar. 5, 2002

(54) ASSEMBLY AND METHOD FOR PROVIDING SHIFT CONTROL FOR A MARINE DRIVE

(75) Inventors: Jeffrey Paul Higby, Grayslake, IL (US); Clarence Blanchard, Pleasant Prarie, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/543,725

(22) Filed: Apr. 5, 2000

(51) Int. Cl.[7] ..... B60K 41/00
(52) U.S. Cl. ..... 440/86; 74/480 B
(58) Field of Search ..... 477/101; 74/480 B; 440/75, 84, 86

(56) References Cited

U.S. PATENT DOCUMENTS

| | | | | |
|---|---|---|---|---|
| 2,894,403 A | | 7/1959 | Tomko | |
| 3,418,867 A | | 12/1968 | Maeda | |
| 3,575,565 A | | 4/1971 | Silvius | |
| 3,728,913 A | | 4/1973 | Nagasaki | |
| 3,830,599 A | | 8/1974 | Poehlman | |
| 3,844,390 A | | 10/1974 | Lowery | |
| 3,977,356 A | | 8/1976 | Kroll | |
| 4,109,540 A | | 8/1978 | Habiger | |
| 4,112,866 A | | 9/1978 | Lissen | |
| 4,262,622 A | * | 4/1981 | Dretzka et al. | 440/1 |
| 4,276,034 A | | 6/1981 | Kashmerick | |
| 4,295,835 A | | 10/1981 | Mapes et al. | |
| 4,297,907 A | | 11/1981 | Bossler, Jr. et al. | |
| 4,395,240 A | | 7/1983 | Blanchard | |
| 4,432,734 A | | 2/1984 | Bland et al. | |
| 4,497,346 A | | 2/1985 | Hintsch et al. | |
| 4,531,429 A | | 7/1985 | Shutt et al. | |
| 4,753,618 A | | 6/1988 | Entringer | |
| 4,789,366 A | | 12/1988 | Hale et al. | |
| 4,802,871 A | | 2/1989 | Watanabe et al. | |
| 4,838,822 A | | 6/1989 | Friedle et al. | |
| 4,850,910 A | | 7/1989 | Higby et al. | |
| 4,863,406 A | | 9/1989 | Bland et al. | |
| 4,897,058 A | | 1/1990 | McCormick | |
| 4,903,662 A | * | 2/1990 | Hirukawa et al. | 123/418 |
| 4,969,370 A | | 11/1990 | Havasaka | |
| 4,990,112 A | | 2/1991 | Imaeda | |
| 5,122,084 A | | 6/1992 | Lieb et al. | |
| 5,141,457 A | | 8/1992 | Onoue | |
| 5,151,059 A | | 9/1992 | Higby | |
| 5,277,634 A | | 1/1994 | Calamia et al. | |
| 5,545,064 A | | 8/1996 | Tsunekawa et al. | |
| 5,601,464 A | | 2/1997 | Ogino et al. | |
| 5,853,346 A | | 12/1998 | Gaffney | |

* cited by examiner

*Primary Examiner*—Ed Swinehart
(74) *Attorney, Agent, or Firm*—Timothy J. Ziolkowski; Cook & Franke SC

(57) ABSTRACT

A shift control method and assembly for a marine drive having a transmission with a clutch member movable between a neutral position and a drive position are provided. The assembly includes a first lever responsive to a remotely actuated link and a second lever is connected to drive the clutch member. The assembly further includes a clutch subassembly interconnected between the first and second levers. The clutch subassembly is configured to selectively pivot the second lever to effect movement of the clutch member, and to permit over-travel of the link connected to the first lever without pivoting the second lever upon engagement of the clutch member in the drive position. The clutch member may be returned to neutral without first having to recover any initial overstroke, that is, when it is desired to return the transmission to neutral, rotation of the first lever immediately rotates the second lever, such that the transmission returns to neutral before the first lever reaches neutral. The clutch subassembly then permits the first lever to complete its return to neutral without causing further rotation of the second lever.

70 Claims, 2 Drawing Sheets

ASSEMBLY AND METHOD FOR PROVIDING SHIFT CONTROL FOR A MARINE DRIVE

BACKGROUND OF THE INVENTION

The invention relates generally to marine propulsion systems, and, more particularly to marine propulsion systems having reversing transmissions and to remote operation of such reversing transmissions by a link, such as a push-pull cable.

Remote actuation of a marine propulsion reversing transmission commonly involves operation of a remote single lever control to displace the inner core of the push-pull cable through a distance which is often in excess of the distance actually required at the marine propulsion system for shifting operation. The over-stroking that results may place unnecessary heavy loading and undesirable stresses on the push-pull cable and/or other shift linkage components.

In the past, attempts have been made to overcome the overstroke issue by interposing a spring in the operating linkage. However, use of such spring suffers from the following drawbacks: delay in shift timing, insufficient load to guarantee shifting, excessive loading after shifting, or over-shooting neutral if a neutral detent is not strong enough. Other designs produce the transmission shift stroke using a rotating shift rod with a horizontally mounted cam or a vertically offset crank pin at the lower end of the shift rod. In such designs overstroke is attempted to be corrected by providing a dwell section on one of the cam surfaces so that additional rotation of the shift rod does not result in additional stress in the shifting system. For example, the dwell section would avoid untimely engagement of a clutch, e.g., a clutch dog, in the transmission. Unfortunately, such designs require tight dimensional control for virtually every shift component. For example, in the foregoing cam design, close dimensional controls are required to ensure that the dwell section of the stroke occurs precisely at the point of full clutch dog engagement. Also, regardless of the close tolerances held on the shift linkage components, the remote control cable may have considerable dead or lost motion, which can vary greatly depending on cable length and the number of bends required in a given installation. To accommodate such lost motion in the cable, a marine engine manufacturer must design the various components of the shift linkage to operate under worst conditions, unfortunately, under most other operational conditions the cable will provide more stroke than necessary. In either case, when an overstroke condition develops, the shift rod, which is generally long and slender, twists as a torsional spring in rotary systems, or bows outward along its length in linear system, and the shift cable may buckle up or stretch inside its casing. It will be appreciated the virtually every shifting system component is subjected to greater stress during the overstroke condition.

In view of the above-described drawbacks, it is a desirable to provide a shift control assembly and techniques that allow for tolerating stroke that may be longer that is needed to shift the clutch in a transmission gearcase without stretching or compressing the push-pull cable and without inducing undesirable stresses in any other shift linkage components. It is further desirable that such assembly and techniques have the ability to return the clutch dog to neutral without having to first recover any initial over-stroke or over-travel. It is also desirable to provide a shift control kit that can be reliably and inexpensively installed either by the engine manufacturer or by authorized service providers as a retrofit kit in respective fleets of boats.

BRIEF SUMMARY OF THE INVENTION

Generally speaking, the present invention fulfills the foregoing needs by providing a shift control assembly for a marine drive having a transmission with a clutch member movable between a neutral position and a respective drive position. The assembly comprises a first lever responsive to a remotely actuated link and a second lever is connected to drive the clutch member. The assembly further comprises a clutch subassembly interconnected between the first and second levers. The clutch subassembly is configured to selectively pivot the second lever to effect movement of the clutch member, and to permit over-travel of the link connected to the first lever without pivoting the second lever upon engagement of the clutch member in the drive position.

The present invention further fulfills the foregoing needs by providing clutch means for selectively pivoting the second lever to effect movement of the clutch member out of its respective drive position upon initial rotation of the first lever back toward neutral. The clutch means is configured to cause the second lever to pivot together with the first lever until the second lever has fully returned to neutral, at which point the first lever continues to pivot to its neutral position without causing further rotation of the second lever. At any point within the full range of rotation of the first lever, reversing the direction of rotation of the first lever will again immediately cause the second lever to pivot together with the first lever. Therefore, in operation, it is not necessary for the first lever to completely return to neutral should the operator decide to return to the fully engaged drive position. It will be appreciated, however, that both levers should preferably return to neutral before the operator can select the opposite drive position.

In another aspect of the invention, the foregoing needs are fulfilled by providing a method for providing shift control for a marine drive having a transmission with a clutch member movable between a neutral position and a drive position. The method allows for providing a first lever responsive to a remotely actuated link and for connecting a second lever to drive the clutch member. The method further allows for selectively pivoting the second lever to effect movement of the clutch member at least until engagement of the clutch member in the drive position and upon said engagement allowing over-travel of the link connected to the first lever without further pivoting of the second lever.

BRIEF DESCRIPTION OF THE DRAWINGS

The features and advantages of the present invention will become apparent from the following detailed description of the invention when read with the accompanying drawings in which.

Figure 1:
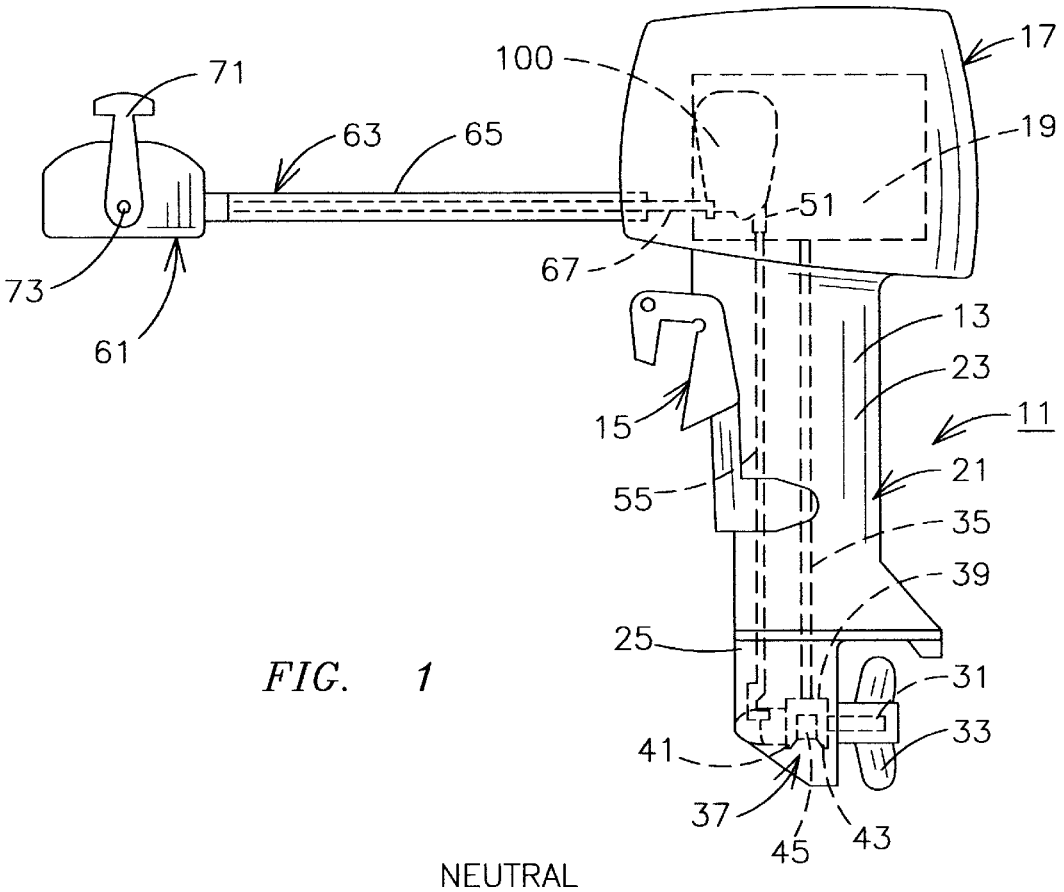
FIG. 1 is a side elevational view of an exemplary marine propulsion system that may benefit from a shift control assembly embodying the present invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

Shown in FIG. 1 is a marine propulsion system 11 which can be either a stem drive unit or an outboard motor and, for the purposes of exemplary illustration, is shown in the form of an outboard motor.

The marine propulsion system includes a propulsion unit 13 and mounting means 15 connected to the propulsion unit and adapted for mounting the propulsion unit 13 from the transom (not shown) of a boat for tilting/trimming movement in a generally vertical plane and for steering movement in a generally horizontal plane. The propulsion unit 13 includes a power head 17 which comprises an internal combustion engine 19 having a crankshaft (not shown) and which is mounted on a lower unit 21 including an upper driveshaft housing 23 and a lower gear case 25.

Extending in the gearcase 25 is a propeller shaft 31 which carries a propeller 33 and which is connected to a driveshaft 35 by a reversing clutch or transmission 37. The driveshaft 35 extends through the driveshaft housing 23 and, at its upper end, is drivingly connected to the engine crankshaft.

The reversing transmission 37 includes a drive pinion 39 fixed to the lower end of the driveshaft 35 and in meshing engagement with a pair of spaced counter rotating bevel gears 41 and 43 mounted in co-axial relation to the propeller shaft 31. A dog or clutch member 45 is splined to the propeller shaft 31 and is shiftable axially relative to the propeller shaft between a central or neutral position out of driving engagement with the bevel gears 41 and 43, a forward drive position located in axially spaced relation in one direction from the neutral position and in driving engagement with one of the bevel gears 41 and 43, and a rearward drive position located in axially spaced relation in the other direction from the neutral position and in driving engagement with the other one of the bevel gears 41 and 43.

Means are provided in the propulsion unit for displacing the clutch member or dog 45 between its neutral, forward drive, and rearward drive positions. While various arrangements can be employed, in the construction illustrated in FIG. 1, such means comprises a shift lever 51 which is movably mounted on the propulsion unit 13 and which is connected by a suitable linkage to the clutch member or clutch dog 45 to cause movement thereof in response to shift lever movement.

Various linkages are known in the art for connecting the shift lever 51 to the clutch member 45. In the illustrated construction, the shift lever 51 is mounted for pivotal movement on a horizontal pivot axis and the linkage includes a vertically movable member 55, such as a connecting rod, extending lengthwise in the driveshaft housing 23. However, the shift lever 51 could be mounted on a vertical pivot and the vertically extending member could be rotatable about its lengthwise axis to effect shifting of the clutch member or dog 45.

In the preferred embodiment remotely located from the marine propulsion device 11 is a single lever control 61 which is adapted to be connected to the marine propulsion device 11 for actuation of the reversing transmission 37 by a push-pull cable 63 including an outer sheath 65 and an inner core or link 67. Any suitable single lever control can be employed. In the disclosed construction, the single lever control 61 includes a control lever 71 which is pivotable about an axis 73, which lever is actuated by an operator, and is connected to the inner core 67. As shown, the control lever 71 is in the neutral position. Movement of the control lever 71 in the counter-clockwise direction from the upright neutral position shown in FIG. 1, displaces the inner core 67 relative to the outer sheath 65 to the right in the drawings and movement of the control lever 71 in the clockwise direction from the neutral position displaces the inner core 67 relative to the outer sheath 65 to the left in the drawings. As thus far disclosed, the construction is conventional.

Figure 2:
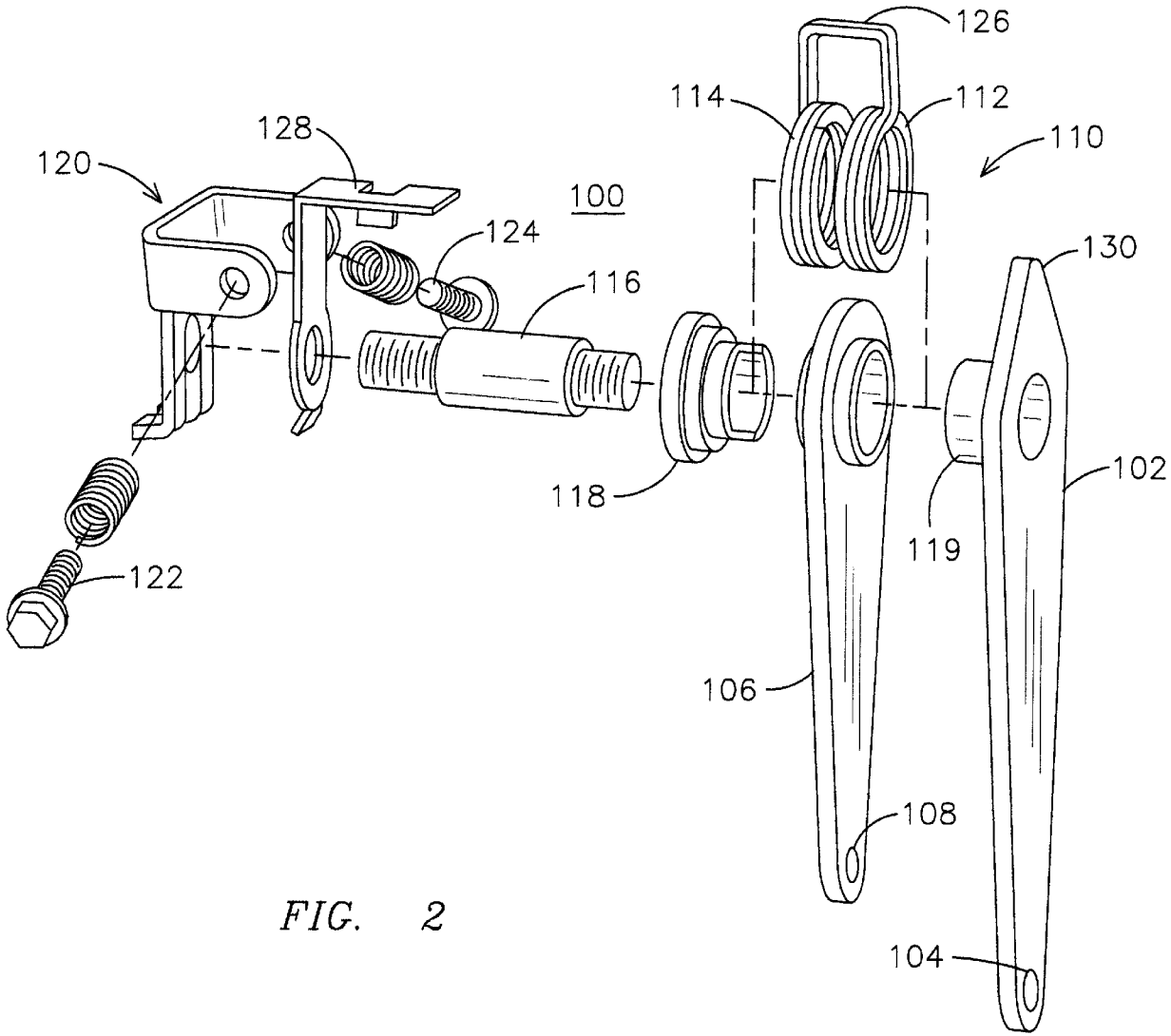
FIG. 2 is an exploded view of the shift control assembly shown in FIG. 1.

As better shown in FIG. 2, the marine propulsion device 11 is provided with a shift control assembly 100 for connecting inner core 67 of cable 63 to a first lever 102 at a suitable attachment point, e.g., attachment point 104. Assembly 100 further includes a second lever 106 connected to drive clutch member 45 via movable member 55 connected to second lever 106 at a suitable attachment point, e.g., attachment point 108. A clutch subassembly 110 is interconnected between the first and second levers, and as shown in FIG. 2, comprises two oppositely wound springs 112 and 114. Clutch subassembly 110 allows for selectively pivoting second lever 106 to effect movement of clutch member 45, and to permit over-travel of the remotely activated link connected to first lever 102 without any further pivoting of the second lever upon engagement of the clutch member in a respective drive position. Clutch subassembly 110 further allows for resetting the first and second levers 102 and 106 to the neutral or central position from a respective drive position independently of any link over-travel, that is, clutch subassembly 110 may return the clutch dog to neutral without having to first recover any initial overstroke.

More particularly, in operation, clutch subassembly 110 forces immediate rotation of second lever 106 out of its neutral position upon rotation of the first lever 102. When second lever 106 has forced the clutch dog 45 into either of its fully engaged positions, the clutch subassembly permits continued rotation of the first lever 102 without further rotation of the second lever 106, or additional stress to the linkage. The clutch subassembly 110 further provides the identical function during the disengagement of the clutch dog 45. Specifically, operator movement of the remote control shift lever 71 back toward neutral causes rotation of first lever 102 back toward its neutral position. Clutch subassembly 110 again forces immediate rotation of second lever 106 back towards its neutral position. When the second lever 106 has fully returned to neutral, and clutch dog 45 has also been returned to neutral through the connecting linkage, the clutch assembly 110 disconnects the first lever 102 from the second lever 106, such that the additional rotation of first lever 102 required to return to its neutral position does not result in additional rotation of second lever 106, or any additional stresses in any of the linkage.

Figure 3:
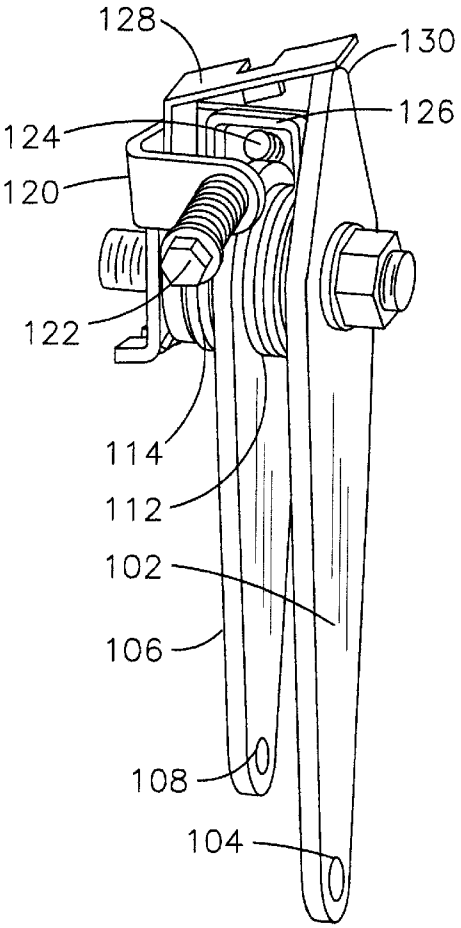
FIG. 3 is an isometric view of the shift control assembly shown in FIG. 2 shown in a neutral position.

A shaft 116 in assembly 100 supports first and second levers 102 and 106, coupled to clutch subassembly 110 through respective hubs 118 and 119 which selectively receive driving motion from first lever 102 to drive second lever 106. Shaft 116 further supports a bracket 120 that in turn supports respective adjustable stops 122 and 124, such as respective screws or bolts. Each of the respective adjustable stops 122 and 124 is adjusted to contact a clutch subassembly projection 126 upon engagement of clutch member 45 in a respective drive position. It will be appreciated that contact of clutch subassembly projection 126 with a respective one of stops 122 or 124 prevents any further pivoting motion of second lever 106 even in the presence of link over-travel. Bracket 120 further comprises a release tab 128 preferably comprising a spring-loaded tab, such as a leaf spring, etc. Clutch subassembly 110 further allows for simultaneously pivoting the first and second lever 102 and 106 from a respective drive position to the neutral position, at least until release tab 128 contacts clutch subassembly projection 126. Contact of clutch subassembly projection 126 with release tab 128 permits further pivotal motion of first lever 102 to compensate for any lag due to link over-travel while second lever 106 remains at the neutral position. As best shown in FIG. 3, first lever 102 comprises a projection 130 configured to contact release tab 128 upon first lever 102 returning to the neutral position.

In operation, when first and second levers 102 and 106 is each in the neutral position, both springs 112 and 114 are engaged through the respective hubs 118 and 119 of the first and second levers, so that any movement of first lever 102 will instantly cause second lever 106 to pivotally move in the same direction of rotation. It will be appreciated that since the two springs 112 and 114 are oppositely wound relative to one another, one of such springs will slip while the other spring is driving, that is, one of the springs will be tightening while the other is loosening.

Figure 4:
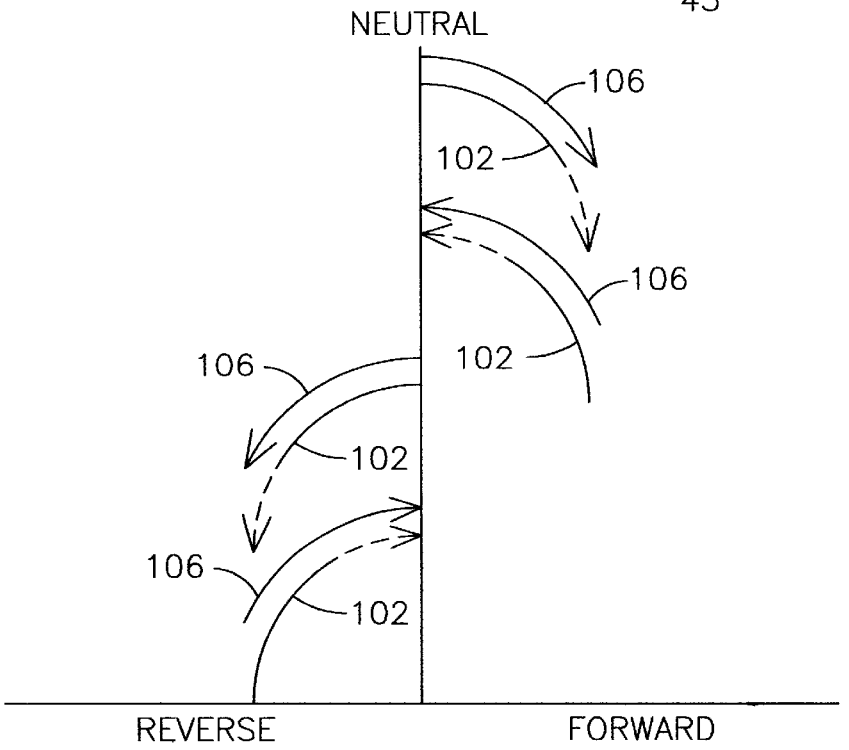
FIG. 4 shows exemplary travel of first and second levers in the shift control assembly of the present invention while moving to engage a respective drive position from a neutral position and while returning to the neutral position.

At the instant that clutch member 45 reaches either full forward or reverse engagement, clutch subassembly projection 126 contacts one of the adjustable stops, thus disengaging clutch subassembly 110, that is, any further pivot motion of first lever 102 does not cause any further pivoting motion of second lever 106 and, consequently, link over-travel is permitted without causing any undesirable stresses on the shift system components. The foregoing sequence is conceptually represented in FIG. 4 by arcs 102 and 106 pointing away from the neutral position to a respective drive position, such as forward or reverse. In each case, the solid line arc segments represent simultaneous pivotal motion of levers 102 and 106 from the neutral position to a drive position while the dashed arc segment represents an exemplary link-overtravel of lever 102 while lever 106 remains stationary upon clutch member 45 (FIG. 1) being engaged in the desired drive position at the respective drive position.

When the link cable and attached first lever 102 are moved in an opposite direction from the fully engaged drive position, the respective spring that was slipping throughout the entire previous stroke will instantly engage both levers 102 and 106, while the other spring will now slip. Since second lever 106 will now be moving in an opposite direction, that is, returning to the neutral or central position, second lever 106 causes moveable member 55 (FIG. 1) to move so as to instantly disengage the clutch dog without having to first recover any link-overtravel from the previous engagement or shifting stroke. When second lever 106 and the clutch dog reach the neutral position, it will be appreciated that first lever 102, the link cable connected thereto and the remote control lever will be lagging due to the overstroke or over-travel at the end of the previous engagement stroke. At this point, release tab 128, which is set to remain at neutral and need not be adjustable, contacts clutch subassembly projection 126, which causes release of clutch subassembly 110. This allows first lever 102, which as suggested above is attached to the push-pull cable and to remote control lever (FIG. 1) to continue moving toward neutral without any further pivotal movement of second lever 106 and any associated components. As shown in FIG. 3, as first lever 102 reaches the neutral position, projection 130 on first lever 102 contacts release tab 128 and deflects it out of engagement with the clutch subassembly projection 126. This allows to reset clutch subassembly 110 for a new stroke in either direction, with all components back in their respective neutral positions. The foregoing sequence is once again conceptually represented in FIG. 4 by arcs 102 and 106, respectively representing motion of the first and second levers from a respective drive position to the neutral position. In each case, the solid line arc segments represent simultaneous pivotal motion of levers 102 and 106 from a drive position back to the neutral position while the dashed arc segment represents an exemplary lag of lever 102 relative to lever 106. It will be appreciated that such lag directly corresponds to the link over-travel introduced in the stroke to engage the drive position. It will be appreciated that lever 106 either when traveling from the neutral position to a desired drive position or back to the neutral position is unaffected by any link-overtravel since any such overtravel is not transmitted by the clutch assembly 100 to lever 106 from lever 102.

During assembly of the marine propulsion system, the various shift linkage components may be installed in their respective neutral or central positions, and the clutch subassembly release adjusting screws may be fully retracted. First lever 102 may then be moved toward either forward or reverse, thus moving the various shift linkage components with it until the clutch dog reaches full engagement. Since the adjusting screws are intentionally out of range, the first lever may generally stop moving early in the stroke. While maintaining a relatively light pressure on first lever 102, the appropriate adjusting screw may be gradually turned in until it contacts clutch subassembly projection 126, which immediately causes the first lever to be released or disengaged from the second lever. The same procedure may be used to adjust the release point for the other shift direction. It will be appreciated that no other adjustments are necessary in the shift control assembly, even after post-assembly of the propulsion system, such as may occur during subsequent installation of a new shift cable by authorized service personnel. New adjustments would be necessary only if that personnel were to replace the entire shift linkage and such adjustment would be identical to that used at the manufacturing site, as described above.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A shift control assembly for a marine drive having a transmission with a clutch member movable between a neutral position and a drive position, the assembly comprising:

a first lever responsive to a remotely actuated link;

a second lever capable of driving a clutch member of a transmission; and a clutch subassembly being configured to selectively pivot the second lever to effect movement of the clutch member, and to permit over-travel of the link connected to the first lever without pivoting the second lever upon engagement of the clutch member in a drive position.

2. The assembly of claim 1 wherein the clutch subassembly is further configured to permit resetting the first and second levers to the neutral position from a respective drive position independently of any link over-travel.

3. The assembly of claim 2 wherein the clutch subassembly comprises two oppositely wound springs.

4. The assembly of claim 3 further comprising a bracket for supporting respective adjustable stops.

5. The assembly of claim 4 wherein the clutch subassembly further comprises a respective projection.

6. The assembly of claim 5 wherein each of the respective adjustable stops is configured to contact the clutch subassembly projection upon engagement of the clutch member in the drive position.

7. The assembly of claim 6 wherein contact of the clutch subassembly projection with a respective stop prevents any further pivoting motion of the second lever arm even in the presence of link over-travel.

8. The assembly of claim 5 wherein the bracket further comprises a release tab.

9. The assembly of claim 8 wherein the clutch subassembly allows for simultaneously pivoting the first and second levers from the drive position to the neutral position, at least until the release tab contacts the clutch subassembly projection.

10. The assembly of claim 9 wherein contact of the clutch subassembly projection with the release tab permits further pivotal motion of the first lever to compensate for any lag therein due to link over-travel while the second lever remains at the neutral position.

11. The assembly of claim 10 wherein the first lever comprises a projection configured to contact the release tab upon the first lever returning to the neutral position.

12. The assembly of claim 1 wherein the drive position comprises a plurality of drive positions.

13. The assembly of claim 12 wherein the drive position comprises forward and reverse drive positions.

14. The assembly of claim 12 wherein the plurality of drive positions comprises multiple drive positions.

15. A marine propulsion system comprising:

a transmission having a clutch member movable between a neutral position and a drive position; and a shift control assembly coupled to the clutch member, the shift control assembly in turn comprising:

a first lever responsive to a remotely actuated link;

a second lever connected to drive the clutch member; and a clutch subassembly interconnected between the first and second levers, said clutch subassembly being configured to selectively pivot the second lever to effect movement of the clutch member, and to permit over-travel of the link connected to the first lever without pivoting the second lever upon engagement of the clutch member in the drive position.

16. The propulsion system of claim 15 wherein the clutch subassembly is further configured to permit resetting the first and second levers to the neutral position from a respective drive position independently of any link over-travel.

17. The propulsion system of claim 16 wherein the clutch subassembly comprises two oppositely wound springs.

18. The propulsion system of claim 17 further comprising a bracket for supporting respective adjustable stops.

19. The propulsion system of claim 18 wherein the clutch subassembly further comprises a respective projection.

20. The propulsion system of claim 19 wherein each of the respective adjustable stops is configured to contact the clutch subassembly projection upon engagement of the clutch member in the drive position.

21. The propulsion system of claim 20 wherein contact of the clutch subassembly projection with a respective stop prevents any further pivoting motion of the second lever arm even in the presence of link over-travel.

22. The propulsion system of claim 19 wherein the bracket further comprises a release tab.

23. The propulsion system of claim 22 wherein the clutch subassembly allows for simultaneously pivoting the first and second levers from the drive position to the neutral position, at least until the release tab contacts the clutch subassembly projection.

24. The propulsion system of claim 23 wherein contact of the clutch subassembly projection with the release tab permits further pivotal motion of the first lever to compensate for any lag therein due to link over-travel while the second lever remains at the neutral position.

25. The propulsion system of claim 24 wherein the first lever comprises a projection configured to contact the release tab upon the first lever returning to the neutral position.

26. The propulsion system of claim 15 wherein the drive position comprises a plurality of drive positions.

27. The propulsion system of claim 26 wherein the drive position comprises forward and reverse drive positions.

28. The propulsion system of claim 26 wherein the plurality of drive positions comprises multiple drive positions.

29. A transmission for a marine propulsion system, the transmission comprising:

a clutch member movable between a neutral position a respective drive position; and a shift control assembly coupled to the clutch member, the shift control assembly in turn comprising:

a first lever responsive to a remotely actuated link;

a second lever connected to drive the clutch member; and a clutch subassembly interconnected between the first and second levers, said clutch subassembly being configured to selectively pivot the second lever to effect movement of the clutch member, and to permit over-travel of the link without pivoting the second lever upon engagement of the clutch member in the drive position.

30. The transmission of claim 29 wherein the clutch subassembly is further configured to permit resetting the first and second levers to the neutral position from a respective drive position regardless of any link over-travel.

31. The transmission of claim 30 wherein the clutch subassembly comprises two oppositely wound springs.

32. The transmission of claim 31 further comprising a bracket for supporting respective adjustable stops.

33. The transmission of claim 32 wherein the clutch subassembly further comprises a respective projection.

34. The transmission of claim 33 wherein each of the respective adjustable stops is configured to contact the clutch subassembly projection upon engagement of the clutch member in the drive position.

35. The transmission of claim 33 wherein contact of the clutch subassembly projection with a respective stop prevents any further pivoting motion of the second lever arm notwithstanding the presence of link over-travel.

36. The transmission of claim 33 wherein the bracket further comprises a release tab.

37. The transmission of claim 36 wherein the clutch subassembly allows for simultaneously pivoting the first and second levers from the drive position to the neutral position, at least until the release tab contacts the clutch subassembly projection.

38. The transmission of claim 37 wherein contact of the clutch subassembly projection with the release tab permits further pivotal motion of the first lever to compensate for any lag therein due to link over-travel while the second lever remains at the neutral position.

39. The transmission of claim 38 wherein the first lever comprises a projection configured to contact the release tab upon the first lever returning to the neutral position.

40. The transmission of claim 29 wherein the drive position comprises a plurality of drive positions.

41. The transmission of claim 40 wherein the drive position comprises forward and reverse drive positions.

42. The transmission of claim 40 wherein the drive position comprises multiple drive positions.

43. A kit for a marine drive having a transmission with a clutch member movable between a neutral position and a drive position, the kit comprising:

a first lever responsive to a remotely actuated link;

a second lever connected to drive the clutch member; and a clutch subassembly being configured to selectively pivot the second lever to effect movement of the clutch member, and to permit over-travel of the link without pivoting the second lever upon engagement of the clutch member in the drive position.

44. The kit of claim 43 wherein the clutch subassembly is further configured to permit resetting the first and second levers to the neutral position from a respective drive position independently of any link over-travel.

45. The kit of claim 44 wherein the clutch subassembly comprises two oppositely wound springs.

46. The kit of claim 45 further comprising a bracket for supporting respective adjustable stops.

47. The kit of claim 46 wherein the clutch subassembly further comprises a respective projection.

48. The kit of claim 47 wherein each of the respective adjustable stops is configured to contact the clutch subassembly projection upon engagement of the clutch member in the drive position.

49. The kit of claim 48 wherein contact of the clutch subassembly projection with a respective stop prevents any further pivoting motion of the second lever arm even in the presence of link over-travel.

50. The kit of claim 47 wherein the bracket further comprises a release tab.

51. The kit of claim 50 wherein the clutch subassembly allows for simultaneously pivoting the first and second levers from the drive position to the neutral position, at least until the release tab contacts the clutch subassembly projection.

52. The kit of claim 51 wherein contact of the clutch subassembly projection with the release tab permits further pivotal motion of the first lever to compensate for any lag therein due to link over-travel while the second lever remains at the neutral position.

53. The kit of claim 52 wherein the first lever comprises a projection configured to contact the release tab upon the first lever returning to the neutral position.

54. The kit of claim 43 wherein the drive position comprises a plurality of drive positions.

55. The kit of claim 54 wherein the drive position comprises forward and reverse drive positions.

56. The kit of claim 54 wherein the plurality of drive positions comprises multiple drive positions.

57. A method for providing shift control for a marine drive having a transmission with a clutch member movable between a neutral position and a drive position, the method comprising:

providing a first lever responsive to a remotely actuated link;

connecting a second lever to drive the clutch member; and selectively pivoting the second lever to effect movement of the clutch member at least until engagement of the clutch member in the drive position and upon said engagement allowing over-travel of the link connected to the first lever without further pivoting of the second lever.

58. The method of claim 57 wherein the selectively pivoting step is executed using a clutch subassembly interconnected between the first and the second levers.

59. The method of claim 57 further comprising allowing the first and second levers to be reset to the neutral position from a respective drive position regardless of link over-travel.

60. The method of claim 59 further comprising a step of providing respective adjustable stops to prevent pivotal motion of the second lever upon engagement of the clutch member in a respective drive position regardless of link over-travel.

61. The method of claim 60 further comprising simultaneously pivoting the first and second levers from the drive position to the neutral position, at least until a release tab is contacted by a projection in the clutch subassembly.

62. The method of claim 61 further comprising allowing further pivotal motion of the first lever to compensate for any lag therein due to link over-travel while the second lever remains at the neutral position.

63. The method of claim 62 further comprising configuring the first lever to have a respective projection for contacting the release tab upon the first lever returning to the neutral position.

64. The method of claim 57 wherein the drive position comprises a plurality of drive positions.

65. The method of claim 64 wherein the drive position comprises forward and reverse drive positions.

66. The method of claim 64 wherein the plurality of drive positions comprises multiple drive positions.

67. A shift control assembly for a marine drive having a transmission with a clutch member movable between a neutral position and a drive position, the assembly comprising:

a first lever responsive to a remotely actuated link;

a second lever capable of driving a clutch member of a transmission; and clutch means interconnected between the first and second levers for pivoting the second lever to effect movement of the clutch member out of its respective drive position upon initial rotation of the first lever back toward neutral.

68. The shift clutch control assembly of claim 67 wherein the clutch means further allows the second lever for pivoting together with the first lever until the second lever has fully returned to neutral, at which point the first lever continues to its neutral position without any further pivoting of the second lever.

69. The shift control assembly of claim 68 wherein the clutch means, upon reversal of the direction of rotation of the first lever, further allows for resuming simultaneous pivoting of the second lever and the first lever.

70. The shift control assembly of claim 69 wherein said resuming of simultaneous pivoting upon reversal of the direction of rotation of the first lever occurs at any point within the range of rotation of the first lever.

* * * * *